US007172434B2

(12) United States Patent
Obikane et al.

(10) Patent No.: US 7,172,434 B2
(45) Date of Patent: Feb. 6, 2007

(54) ELECTRICAL CONNECTION APPARATUS CAPABLE OF RESISTING REPETITION OF CONNECTION AND DISCONNECTION

(75) Inventors: Hiroaki Obikane, Tokyo (JP); Masafumi Kodera, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/439,085

(22) Filed: May 23, 2006

(65) Prior Publication Data

US 2006/0264075 A1 Nov. 23, 2006

(30) Foreign Application Priority Data

May 23, 2005 (JP) ..... 2005-149363

(51) Int. Cl.
*H01R 12/00* (2006.01)

(52) U.S. Cl. ..... 439/74; 439/570

(58) Field of Classification Search ..... 439/74, 439/570, 566

See application file for complete search history.

(56) References Cited

U.S. PATENT DOCUMENTS 5,259,789 A * 11/1993 Patel et al. ..... 439/570
5,928,003 A * 7/1999 Kajinuma ..... 439/74
6,095,824 A * 8/2000 McHugh ..... 439/74
6,254,429 B1 * 7/2001 Morita ..... 439/570
6,464,515 B1 * 10/2002 Wu ..... 439/108
6,986,670 B2 * 1/2006 Okura et al. ..... 439/74
2004/0229484 A1 * 11/2004 Uchida ..... 439/137

FOREIGN PATENT DOCUMENTS

JP 2002 3050547 10/2002
JP 2003 297485 10/2003

* cited by examiner

*Primary Examiner*—Tho D. Ta
(74) *Attorney, Agent, or Firm*—Collard & Roe, P.C.

(57) ABSTRACT

In a connector including an insulating housing holding contacts, the housing is strengthened by two strengthening members made of metal. The housing has a pair of first wall portions extending and spaced from each other and a pair of second wall portions defining a rectangular cavity between the first wall portions in cooperation with the first wall portions. Each of the first wall portions has a wall inner surface faced to the rectangular cavity, a wall outer surface opposite to the wall inner surface, and a wall peripheral surface between the wall inner surface and the wall outer surface. The contacts are disposed on at least one of the second wall portions. The strengthening members are disposed on the first wall portions, respectively, and extending along at least one of the wall inner surface and the wall outer surface.

14 Claims, 12 Drawing Sheets

ELECTRICAL CONNECTION APPARATUS CAPABLE OF RESISTING REPETITION OF CONNECTION AND DISCONNECTION

This application claims priority to prior Japanese patent application JP 2005-149363, the disclosure of which is incorporated herein by reference.

BACKGROUND OF THE INVENTION

This invention relates to a plug connector, a receptacle connector, and an electrical connection apparatus comprising a combination of the plug connector and the receptacle connector.

In recent years, a multi-pin connector for electrical connection is used in a mobile or portable apparatus. Since the portable apparatus is developed towards a small size, parts of the apparatus are also required to be small in size. Therefore, in the multi-pin connector of the type, it is essential to narrow a pitch of a plurality of contacts held by an insulator. However, when the pitch is narrowed, a distance between adjacent ones of the contacts is reduced. In this case, a quality related to contacting conditions tends to be adversely affected.

For example, Japanese Unexamined Patent Application Publication (JP-A) No. 2003-297485 discloses a connector to be electrically and mechanically fixed to a mounting object by the use of hold-downs. Japanese Unexamined Patent Application Publication (JP-A) No. 2002-305047 discloses a connector enhanced in mechanical strength by hold-downs press-fitted into an insulator.

In each of the connectors disclosed in the publications, insulators of a plug connector and a receptacle connector are fitted to each other when the plug and the receptacle connectors are connected to each other. In such a connector, the insulators may be abraded or broken during repetition of fitting and separation of the insulators. It is assumed that, when the plug connector and the receptacle connector are disconnected from each other, the insulators are twisted with respect to each other to be separated. In this event, the insulators may be deformed under strong external force. In either case, proper fitting between the plug connector and the receptacle connector may not be achieved and improper contacting or short-circuiting may be caused between contacts, resulting in contacting failure.

SUMMARY OF THE INVENTION

It is therefore an object of this invention to provide an electrical connection apparatus capable of resisting repetition of connection and disconnection.

Other objects of the present invention will become clear as the description proceeds.

According to an aspect of the present invention, there is provided a plug connector comprising a plurality of conductive contacts, an insulating plug housing holding the contacts, and two plug strengthening members made of metal for strengthening the plug housing, the plug housing having a pair of first plug wall portions extending and spaced from each other, and a pair of second plug wall portions defining a rectangular cavity between the first plug wall portions in cooperation with the first plug wall portions, each of the first plug wall portions having a plug wall inner surface faced to the rectangular cavity, a plug wall outer surface opposite to the plug wall inner surface, and a plug wall peripheral surface between the plug wall inner surface and the plug wall outer surface, the contacts being disposed on at least one of the second plug wall portions, the plug strengthening members being disposed on the first plug wall portions, respectively, and extending along at least one of the plug wall inner surface and the plug wall outer surface.

According to another aspect of the present invention, there is provided a receptacle connector comprising a plurality of conductive contacts, an insulating receptacle housing holding the contacts, and two receptacle strengthening members made of metal for strengthening the receptacle housing, the receptacle housing having a pair of first receptacle groove portions extending and spaced from each other, and a pair of second receptacle groove portions defining a rectangular block portion between the first receptacle groove portions in cooperation with the first receptacle groove portions, each of the first receptacle groove portions being defined by a receptacle groove inner surface defined by the rectangular block portion, and a receptacle groove outer surface faced to the receptacle groove inner surface, the contacts being disposed to face at least one of the second receptacle groove portions, the receptacle strengthening members extending along at least one of the receptacle groove inner surface and the receptacle groove outer surface to face the first receptacle groove portions, respectively.

According to still another aspect of the present invention, there is provided an electrical connection apparatus comprising the above-mentioned plug connector and the above-mentioned receptacle connector, the first and the second plug wall portions being designed to have sizes adapted to be fitted to the first and the second receptacle groove portions, respectively.

DESCRIPTION OF THE PREFERRED EMBODIMENTS

Figure 1:
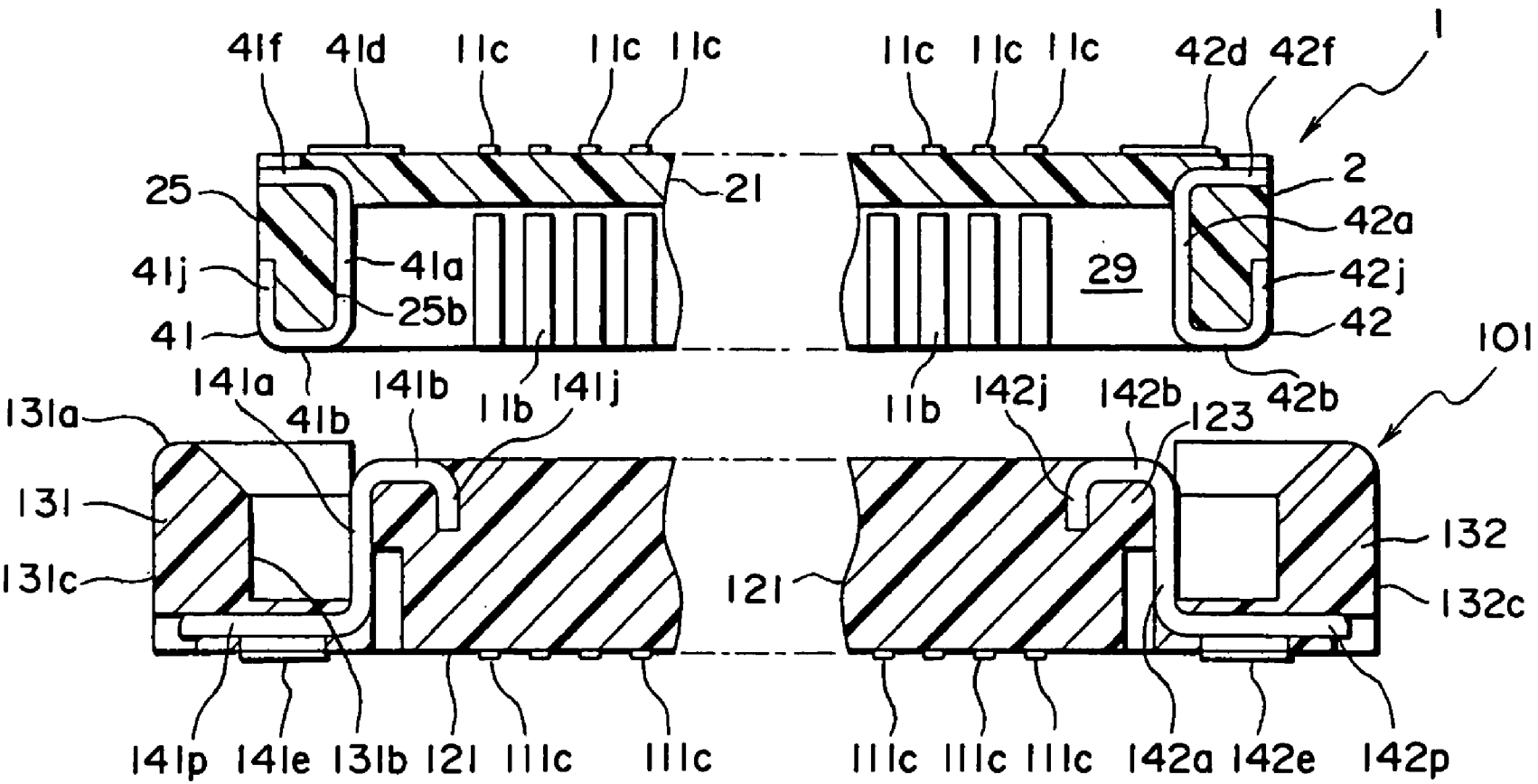
FIG. 1 is a sectional front view of an electrical connection apparatus according to a first embodiment of this invention before fitting.
Figure 2:
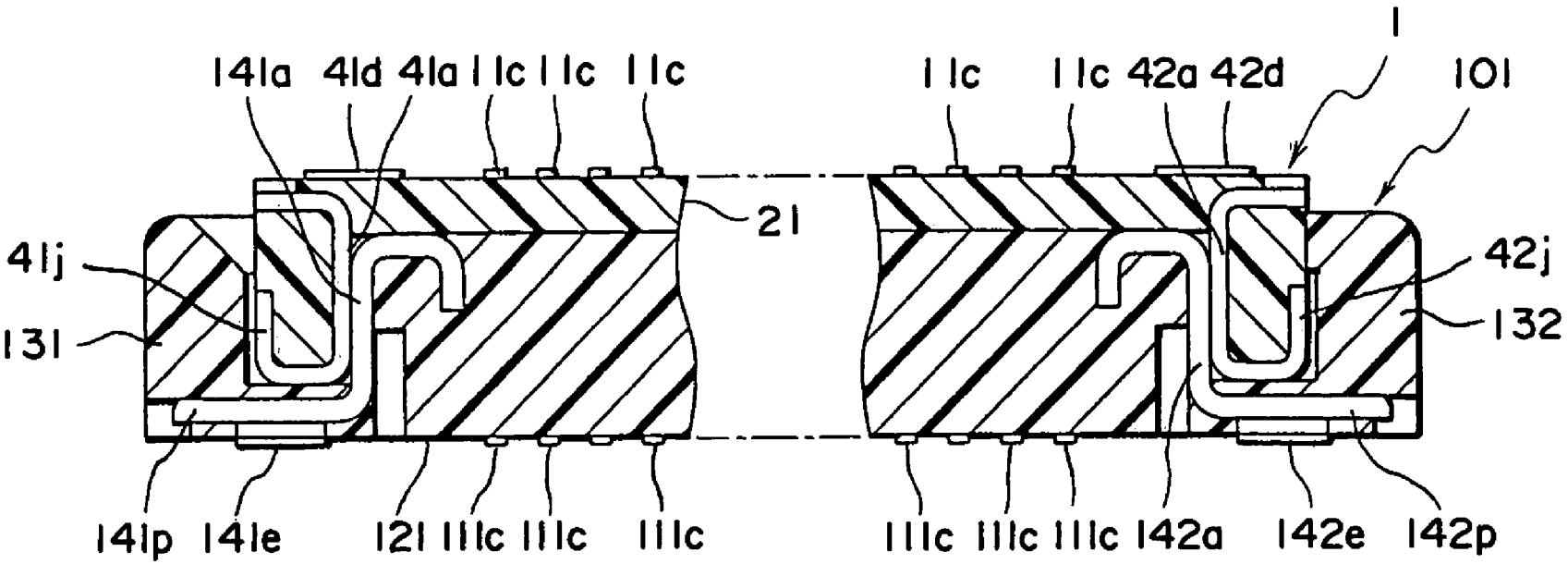
FIG. 2 is a sectional front view of the electrical connection apparatus in FIG. 1 after fitting.

Referring to FIGS. 1 and 2, description will be made of a whole of an electrical connection apparatus according to a first embodiment of this invention.

The electrical connection apparatus illustrated in the figures comprises a plug connector 1 and a receptacle connector 101. When the plug connector 1 and the receptacle connector 101 faced to each other as illustrated in FIG. 1 are moved towards each other, the plug connector 1 and the receptacle connector 101 are fitted to each other as shown in FIG. 2. As a consequence, the plug connector 1 and the receptacle connector 101 are electrically connected to each other.

Figure 3:
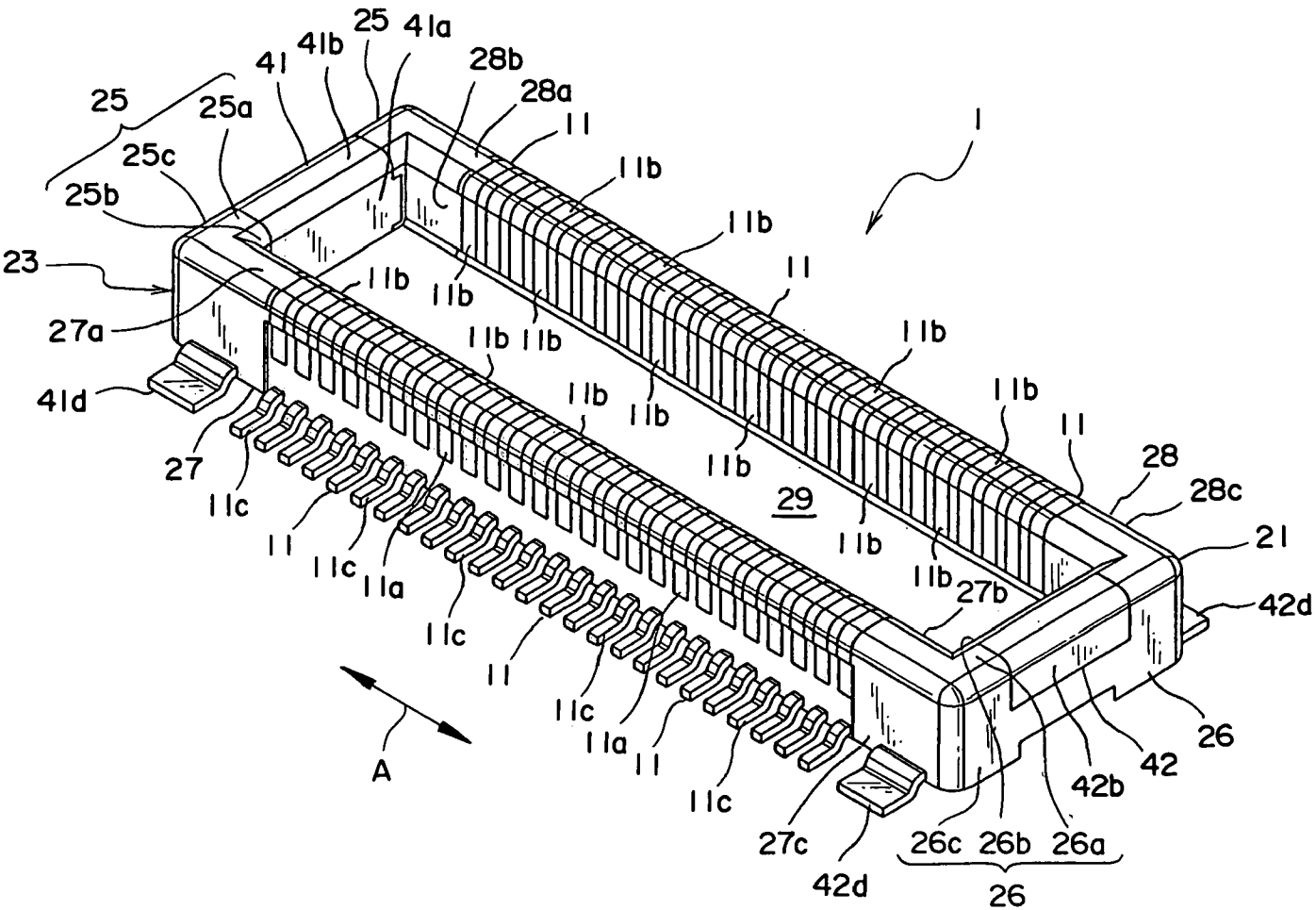
FIG. 3 is a perspective view of a plug connector of the electrical connection apparatus in FIGS. 1 and 2.

Referring to FIG. 3, the plug connector 1 will be described.

The plug connector 1 comprises a plurality of conductive plug contacts 11 and an insulating plug housing 21 holding the plug contacts 11. Each of the plug contacts 11 has a plug holding portion 11*a*, a plug contacting portion 11*b* extending from the plug holding portion 11*a* inward from the plug housing 21, and a plug terminal portion 11*c* extending from the plug contacting portion 11*b* outward the plug housing 21.

The plug housing 21 is obtained by molding a resin material and has a plug-side fitting portion 23 in the form of a rectangular frame. The plug-side fitting portion 23 has a pair of first plug wall portions 25 and 26 extending in parallel to each other with a space left therebetween, and a pair of second plug wall portions 27 and 28 extending in parallel to each other with a space left therebetween. On the second plug wall portions 27 and 28, the plug holding portions 11*a* of the plug contacts 11 are arranged in parallel and spaced from one another in a pitch direction A.

On opposite ends of the plug housing 21 in a longitudinal direction (pitch direction A), the second plug wall portions 27 and 28 connect opposite ends of the first plug wall portions 25 and 26. The first plug wall portions 25 and 26 extend in a direction perpendicular to the pitch direction A of the plug housing 21. Thus, a combination of the first and the second plug wall portions 25, 26, 27, and 28 forms a rectangular cavity 29 inside the plug housing 21.

The first plug wall portions 25 and 26 has plug wall peripheral surfaces or first plug fitting surfaces 25*a* and 26*a*, first plug wall inner surfaces 25*b* and 26*b* adjacent to the first plug fitting surfaces 25*a* and 26*a* inside the plug-side fitting portion 23, and first plug wall outer surfaces 25*c* and 26*c* adjacent to the first plug fitting surfaces 25*a* and 26*a* outside the plug-side fitting portion 23, respectively.

The first plug wall portions 25 and 26 are provided with plug strengthening members 41 and 42 made of metal to cover the first plug fitting surfaces 25*a* and 26*a* and the first plug wall inner surfaces 25*b* and 26*b*, respectively. The plug strengthening members 41 and 42 are held by the plug housing 21. Specifically, the plug strengthening members 41 and 42 are integrally held by the plug housing 21 by mold-in so that surfaces of the plug strengthening members 41 and 42 are substantially flush with surfaces of the first plug wall portions 25 and 26, respectively.

The second plug wall portions 27 and 28 have second plug fitting surfaces 27*a* and 28*a*, second plug wall inner surfaces 27*b* and 28*b* adjacent to the second plug fitting surfaces 27*a* and 28*a* inside the plug-side fitting portion 23, and second plug wall outer surfaces 27*c* and 28*c* adjacent to the second plug fitting surfaces 27*a* and 28*a* outside the plug-side fitting portion 23, respectively.

The plug-side fitting portion 23 holds the plug holding portions 11*a* of the plug contacts 11. The plug contacts 11 have U-shaped portions extending along the second plug fitting surfaces 27*a* and 28*a*, the second plug wall inner surfaces 27*b* and 28*b*, and the second plug wall outer surfaces 27*c* and 28*c*. On lower surfaces of the second plug wall outer surfaces 27*c* and 28*c*, the plug terminal portions 11*c* of the plug contacts 11 extend outward from the plug housing 21 in the direction perpendicular to the pitch direction A.

Figure 4:
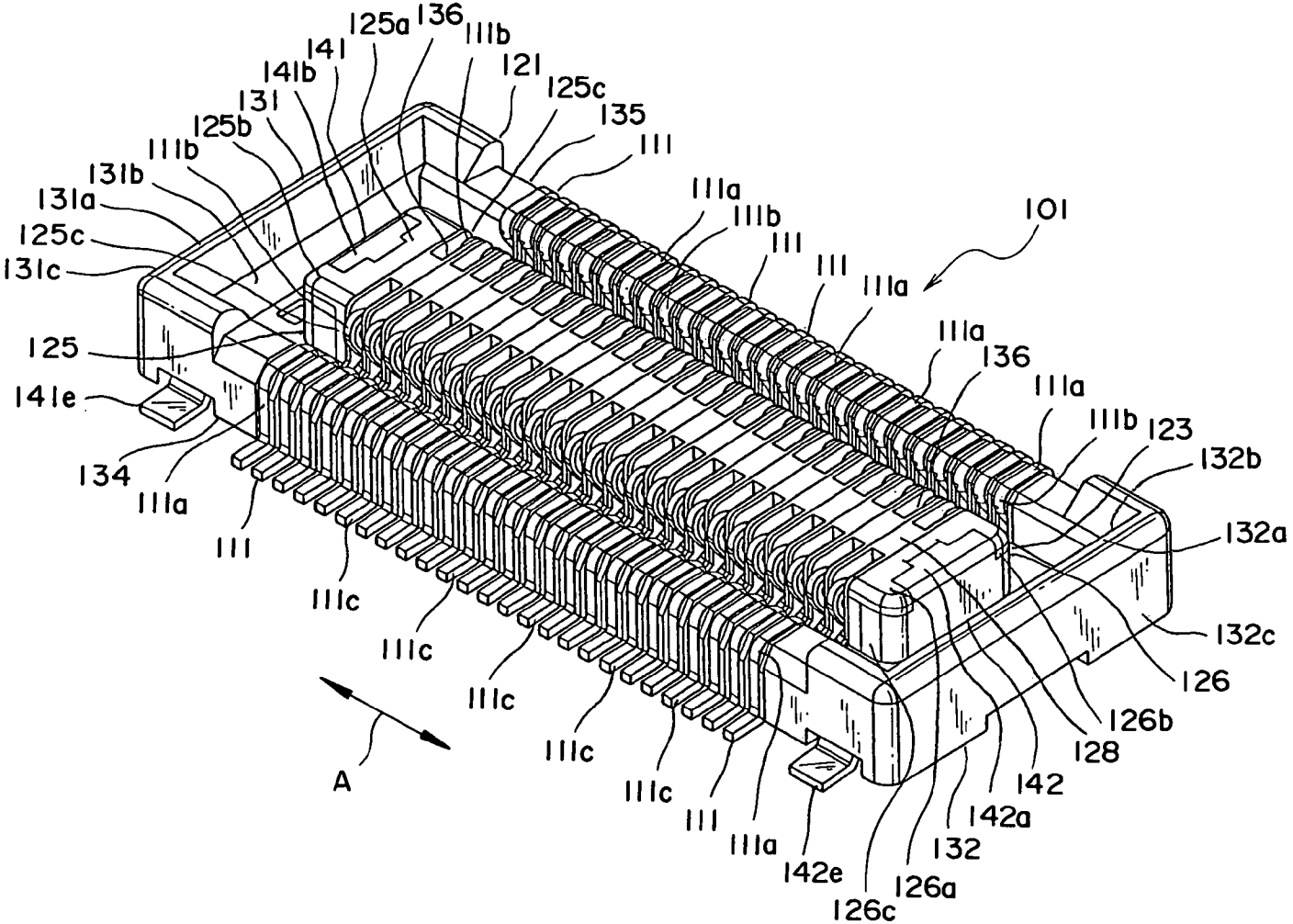
FIG. 4 is a perspective view of a receptacle connector of the electrical connection apparatus in FIGS. 1 and 2.

Referring to FIG. 4 in addition to FIG. 3, the receptacle connector 101 will be described.

The receptacle connector 101 has a plurality of conductive receptacle contacts 111 and an insulating receptacle housing 121 holding the receptacle contacts 111. Each of the receptacle contacts 111 has a receptacle holding portion 111*a*, a receptacle contacting portion 111*b* extending from one end of the receptacle holding portion 111*a* inward the receptacle housing 121, and a receptacle terminal portion 111*c* extending from the other end of the receptacle holding portion 111*a* outward of the receptacle housing 121.

The receptacle housing 121 is obtained by molding a resin material and has a rectangular block portion or receptacle-side fitting portion 123 of a rectangular shape, a pair of first receptacle outer wall portions 131 and 132 extending outside of the receptacle-side fitting portion 123 with a space left therefrom, and a pair of second receptacle outer wall portions 134 and 135 extending outside of the receptacle-side fitting portion 123 with a space left therefrom. The first receptacle outer wall portions 131 and 132 are parallel to each other. The second receptacle outer wall portions 134 and 135 are parallel to each other. The second receptacle outer wall portions 134 and 135 are connected to opposite ends of the first receptacle outer wall portions 131 and 132 in a longitudinal direction. Thus, between the receptacle-side fitting portion 123 and the first receptacle outer wall portions 131 and 132, a pair of grooves or first receptacle groove portions are formed, respectively. Between the receptacle-side fitting portion 123 and the second receptacle outer wall portions 134 and 135, a pair of grooves or second receptacle groove portions are formed, respectively. A combination of the first and the second receptacle groove portions is called a receptacle-side fitting groove. Herein, the receptacle-side fitting groove is designed to have a shape and a size adapted to be fitted to the plug-side fitting portion 23 of the plug connector 1.

The receptacle-side fitting portion 123 has a pair of first receptacle inner wall portions 125 and 126 at opposite ends in the pitch direction A, and a second receptacle inner wall portion 128 connecting the first receptacle inner wall portions 125 and 126. The receptacle contacts 111 are arranged in parallel in the pitch direction A to face the second receptacle groove portions.

The first receptacle inner wall portions 125 and 126 have a pair of first receptacle fitting surfaces 125*a* and 126*a*, a pair of first receptacle inner wall surfaces 125*b* and 126*b*, and a pair of second receptacle inner wall surfaces 125*c* and 126*c*, respectively. On the other hand, the first receptacle outer wall portions 131 and 132 have a pair of first receptacle fitting surfaces 131*a* and 132*a*, a pair of first receptacle inner wall surfaces 131*b* and 132*b*, and a pair of first receptacle outer wall surfaces 131*c* and 132*c*, respectively. Each of the first receptacle inner wall surfaces 125*b* and 126*b* of the first receptacle inner wall portions 125 and 126 is called a receptacle groove inner surface while each of the first receptacle inner wall surfaces 131*b* and 132*b* of the first receptacle outer wall portions 131 and 132 is called a receptacle groove outer surface. The above-mentioned receptacle-side fitting groove is defined by the receptacle groove inner surfaces and the receptacle groove outer surfaces.

The first receptacle inner wall portions 125 and 126 are provided with receptacle strengthening members 141 and 142 made of metal and extending along the receptacle fitting surfaces 125*a* and 126*a* and the first receptacle inner wall surfaces 125*b* and 126*b*. The receptacle strengthening members 141 and 142 are held by the receptacle housing 121. Specifically, the receptacle strengthening members 141 and 142 are integrally held by the receptacle housing 21 by mold-in so that surfaces of the receptacle strengthening members 141 and 142 are substantially flush with surfaces of the first receptacle inner wall portions 125 and 126, respectively.

The second receptacle outer wall portions 134 and 135 have outer surfaces holding the receptacle holding portions 111*a* of the receptacle contacts 111. The receptacle contacting portions 111*b* of the receptacle contacts 111 have a generally U shape and extend from inner surfaces of the second receptacle outer wall portions 134 and 135 to groove portions 136 formed on the receptacle inner wall portions 125 and 126. On lower surfaces of the second receptacle outer wall portions 134 and 135, the receptacle terminal portions 111*c* of the receptacle contacts 111 extend outward of the receptacle housing 121 in the direction perpendicular to the pitch direction A.

Figure 5:
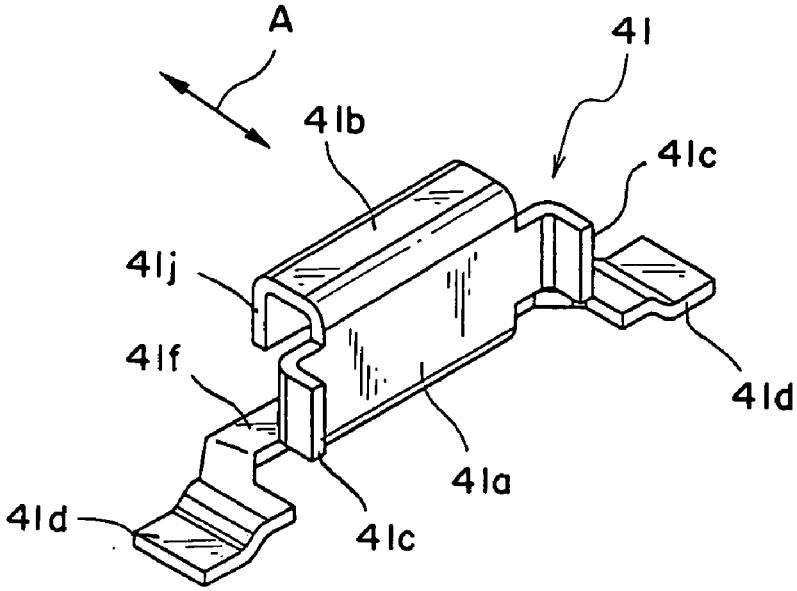
FIG. 5 is a perspective view of a plug strengthening member used in the plug connector in FIG. 3.

Referring to FIG. 5 in addition, the plug strengthening members 41 and 42 will be described. Since the plug strengthening members 41 and 42 have the same shape, the plug strengthening member 41 alone will be described herein. Each of the plug strengthening members 41 and 42 may be produced by punching and then bending a metal plate.

The plug strengthening member 41 has a first plug plate portion 41*a* of a flat shape, a second plug plate portion 41*b* connected to one side of the first plug plate portion 41*a* and bent in a generally inverted-U shape, a pair of third plug plate portions 41*c* generally perpendicularly bent in a direction opposite to the second plug plate portion 41*b*, a plug connecting plate portion 41*f* connected to a lower side of the first plug plate portion 41*a* and generally perpendicularly bent in a direction same as the second plug plate portion 41*b*, and a pair of plug soldering portions 41*d* extending from the plug connecting plate portion 41*f* in the direction perpendicular to the pitch direction A.

The second plug plate portion 41*b* has an end portion 41*j* disposed on the first plug wall outer surface 25*c* of the first plug wall portion 25. The third plug plate portions 41*c* are embedded in the second plug wall portions 27 and 28 upon forming the plug housing 21 by mold-in so that the plug strengthening member 41 is held. The plug soldering portions 41*d* and 42*d* extend in a direction same as the plug terminal portions 11*c* of the plug contacts 11 and are connected to a substrate (not shown) by the use of a solder. The plug terminal portions 11*c* are connected to a conductive pattern of the substrate by the use of a solder.

Figure 6:
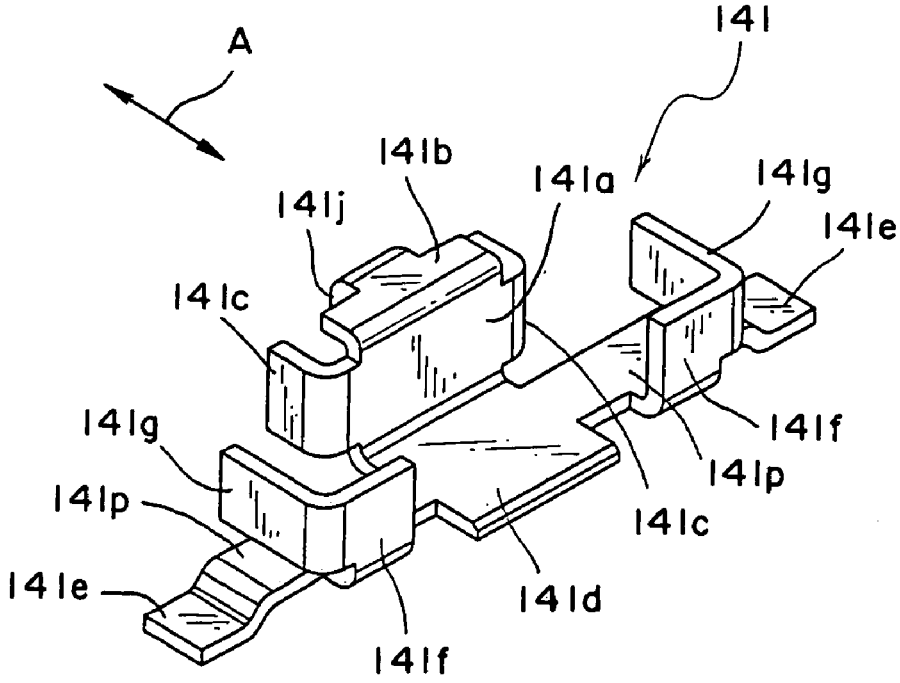
FIG. 6 is a perspective view of a receptacle strengthening member used in the receptacle connector in FIG. 4.

Referring to FIG. 6 also, the receptacle strengthening members 141 and 142 will be described. Since the receptacle strengthening members 141 and 142 have the same shape, the receptacle strengthening member 141 alone will be described herein. Each of the receptacle strengthening members 141 and 142 may be produced by punching and then bending a metal plate.

The receptacle strengthening member 141 has a first receptacle plate portion 141*a* of a flat shape, a second receptacle plate portion 141*b* connected to one side of the first receptacle plate portion 141*a* and bent in a generally inverted-U shape, a pair of third receptacle plate portions 141*c* connected to a pair of other sides of the first receptacle plate portion 141*a* and generally perpendicularly bent in a direction same as the second receptacle plate portion 141*b*, a fourth receptacle plate portion 141*d* connected to a lower side of the first receptacle plate portion 141*a* and generally perpendicularly bent in a direction opposite to the second receptacle plate portion 141*b*, and a pair of receptacle soldering portions 141*e* connected to two sides of the second receptacle plate portion 141*d* through connecting plate portions 141*p* and formed at opposite end portions.

Further, the receptacle strengthening member 141 has a pair of fifth receptacle plate portions 141*f* generally perpendicularly bent with respect to the fourth receptacle plate portion 141*d* in the vicinity of the fourth receptacle plate portion 141*d* and parallel to the first receptacle plate portion 141*a*, and a pair of sixth receptacle plate portions 141*g* bent from the fifth receptacle plate portions 141*f* to be parallel to the third receptacle plate portions 141*c*.

An end portion 141*j* of the second receptacle plate portion 141*b* and the third receptacle plate portions 141*c* are embedded in the receptacle inner wall portion 125 upon forming the receptacle housing 121 by mold-in so that the receptacle strengthening member 41 is integrally held with the receptacle housing 121. The sixth receptacle plate portions 141*g* are embedded in the second receptacle outer wall portions 134 and 135 upon forming the receptacle housing 121 by mold-in. Thus, the receptacle strengthening member 141 is integrally held with the receptacle housing 121.

The receptacle soldering portions 141*e* extend in a direction same as the receptacle terminal portions 111*c* of the receptacle contacts 111 and are connected to a substrate (not shown) by the use of a solder. The receptacle terminal portions 111*c* are connected to a conductive pattern of the substrate by the use of a solder.

The plug soldering portions 41*d* of the plug strengthening member 41 and the receptacle soldering portions 141*e* of the receptacle strengthening member 141 may not be provided if they are unnecessary.

Turning back to FIGS. 1 and 2, description will be made of a relationship between the plug connector 1 and the receptacle connector 101.

From the state shown in FIG. 1, the plug-side fitting portion 23 of the plug connector 1 is received in the receptacle-side fitting portion 123 of the receptacle connector 101 as shown in FIG. 2. When the plug connector 1 and the receptacle connector 101 are fitted to each other as described above, the first plug plate portions 41*a* and 42*a* of the plug strengthening members 41 and 42 and the first receptacle plate portions 141*a* and 142*a* of the receptacle strengthening members 141 and 142 are brought into frictional contact with each other. Therefore, even in a narrow-pitch condition in which distances or intervals of the plug contacts 11 and the receptacle contacts 111 in the pitch direction A are narrow, the possibility of causing improper contacting in the pitch direction A is low.

Upon fitting, the fitting is determined or accomplished by the plug strengthening members 41 and 42 and the receptacle strengthening members 141 and 142. Therefore, it is possible to prevent the plug housing 21 and the receptacle housing 121 from being abraded or broken during repetition of fitting and separation.

Figure 7:
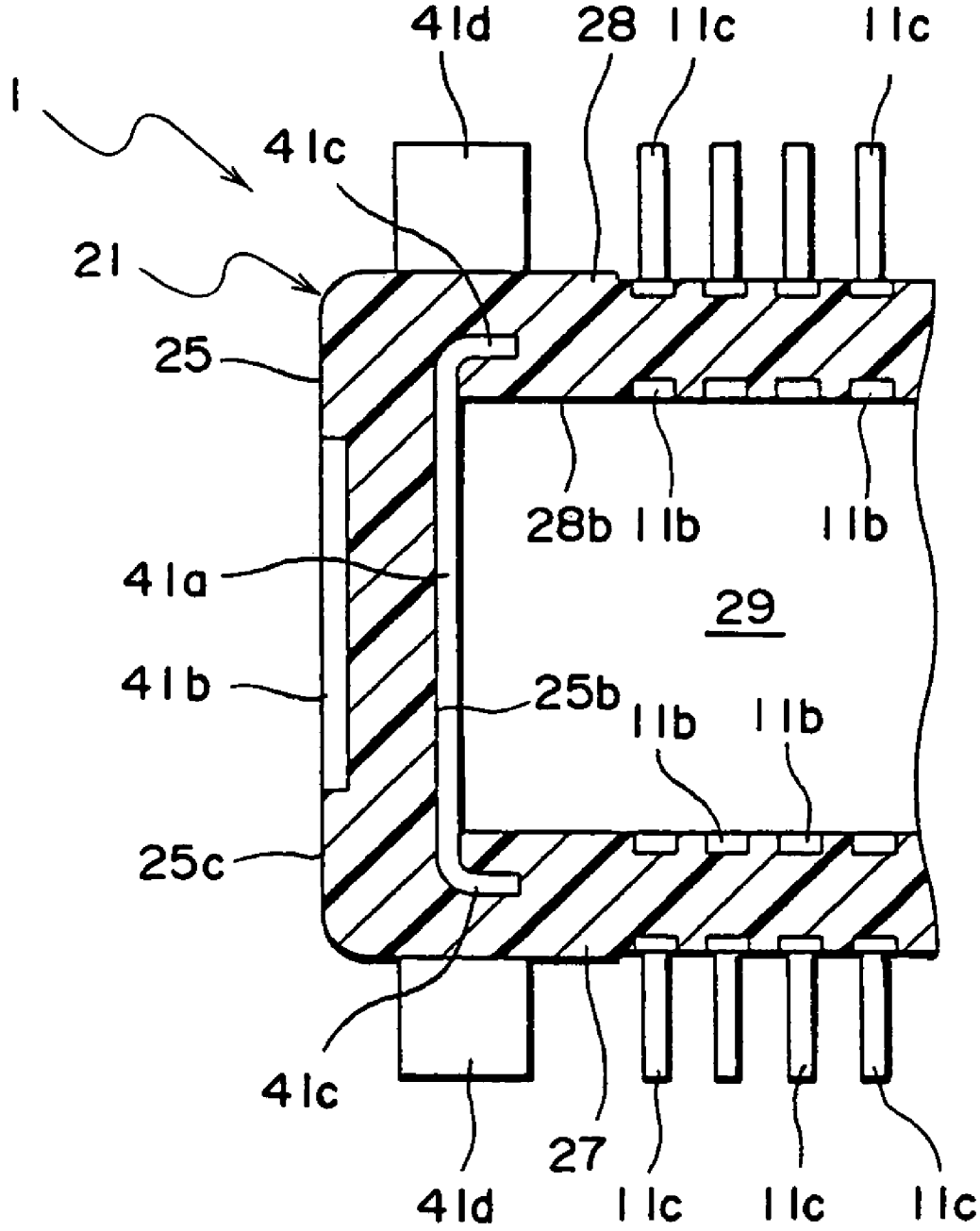
FIG. 7 is a sectional plan view of a part of the plug connector in FIG. 3.
Figure 8:
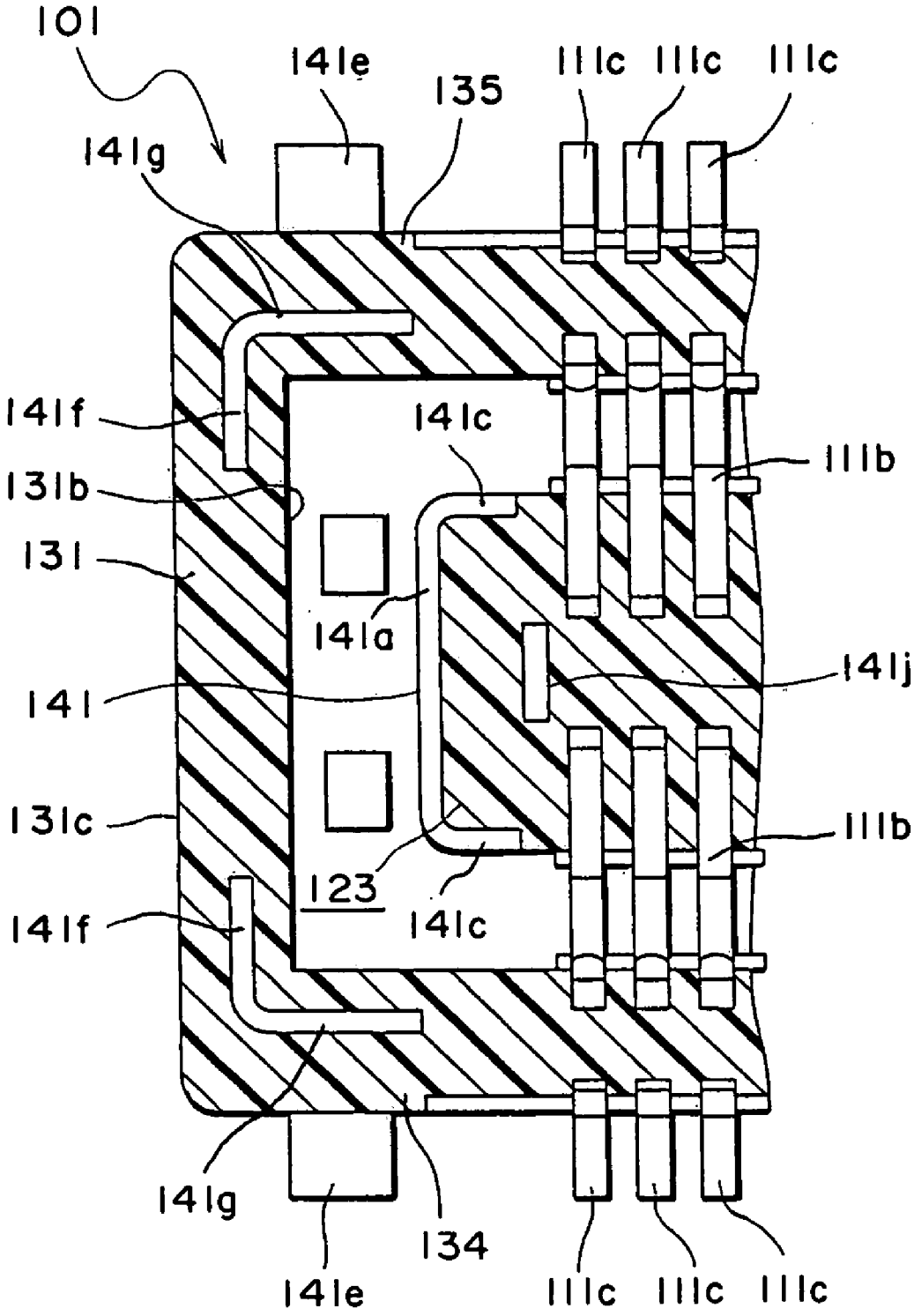
FIG. 8 is a sectional plan view of a part of the receptacle connector in FIG. 4.

Further referring to FIGS. 7 and 8, description will be supplemented.

As is clear from FIG. 7, the third plug plate portions 41*c* of the plug strengthening member 41 are embedded in the second plug wall portions 27 and 28 of the plug housing 21. Therefore, the plug housing 21 is further increased in rigidity. Even if twisting force is applied when the plug connector 1 is separated from the receptacle connector 101, the plug housing 21 is hardly deformed.

As is clear from FIG. 8, the third receptacle plate portions 141*g* and 141*f* of the receptacle strengthening member 141 are embedded in the first receptacle outer wall portion 131 and the second receptacle outer wall portions 134 and 135 of the receptacle housing 121. Therefore, the receptacle housing 121 is further increased in rigidity. Even if twisting force is applied when the plug connector 1 is separated from the receptacle connector 101, the plug housing 21 is hardly deformed.

In the plug strengthening members 41 and 42 and the receptacle strengthening members 141 and 142, a spring member or a protrusion may be formed in one of the plug connector 1 and the receptacle connector 101. Upon fitting, the spring member or the protrusion is brought into contact with the plug strengthening members 41 and 42 or the receptacle strengthening members 141 and 142 in either direction.

Figure 9:
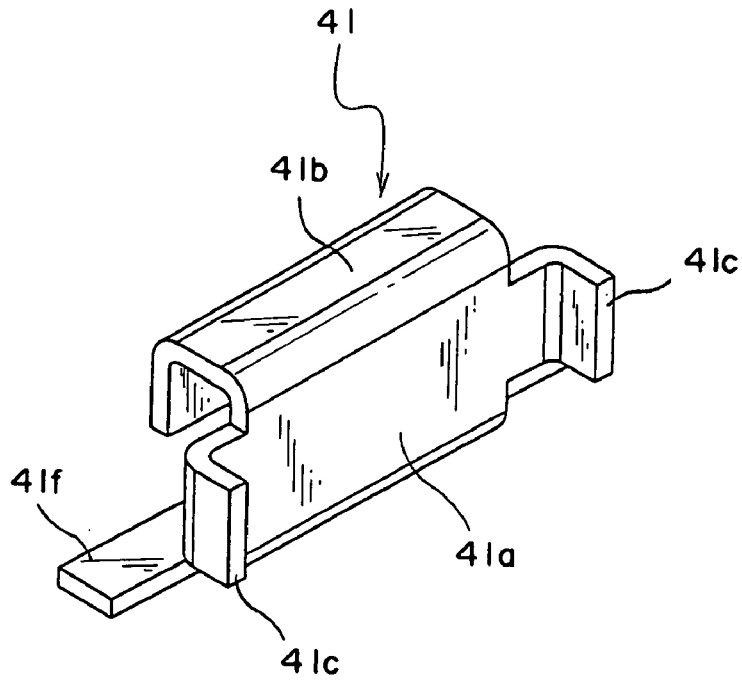
FIG. 9 is a perspective view showing a modification of the plug strengthening member illustrated in FIG. 5.
Figure 10:
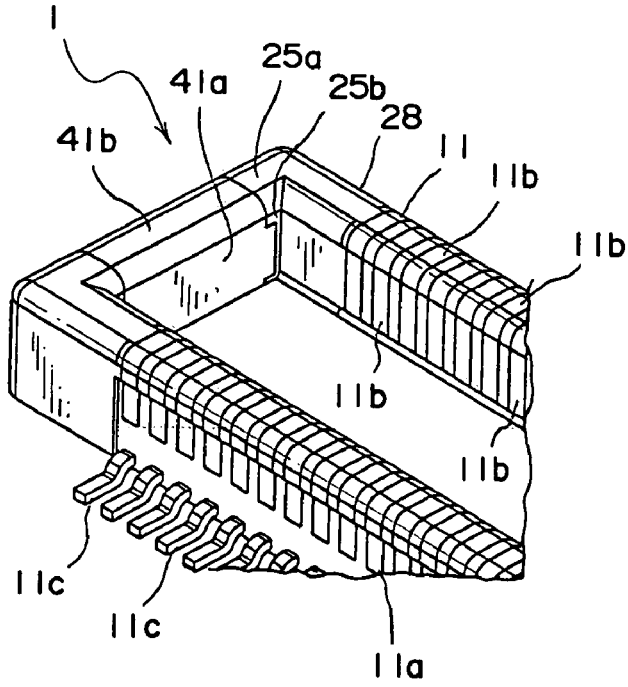
FIG. 10 is a perspective view of a part of the plug connector using the modification illustrated in FIG. 9.

Referring to FIGS. 9 and 10, description will be made of a modification of the plug connector 1.

The plug strengthening member 41 illustrated in FIG. 9 does not have the plug soldering portions mentioned above. The plug connector 1 having the plug strengthening member 41 is shown in FIG. 10. The other plug strengthening member 42 may have or may not have the plug soldering portions.

Figure 11:
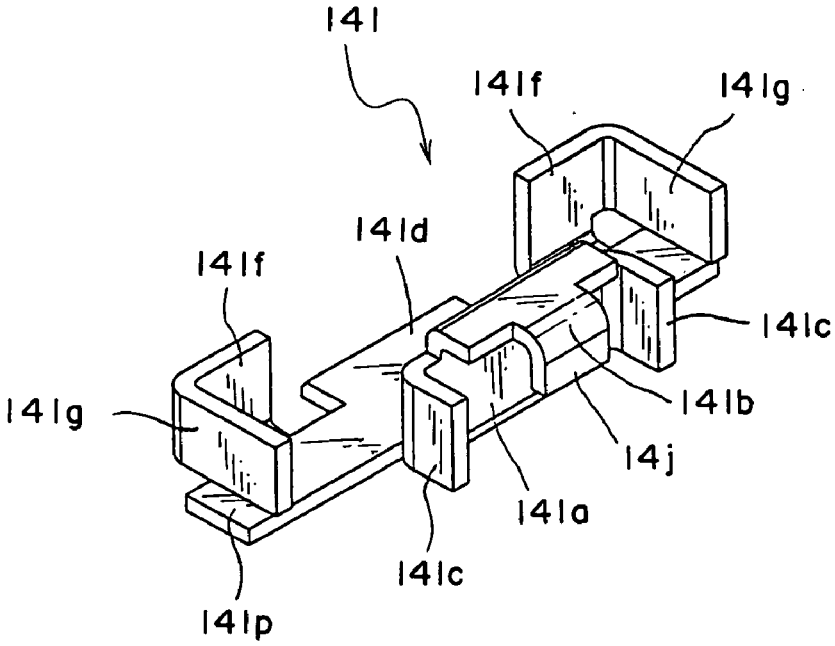
FIG. 11 is a perspective view showing a modification of the receptacle strengthening member illustrated in FIG. 6.
Figure 12:
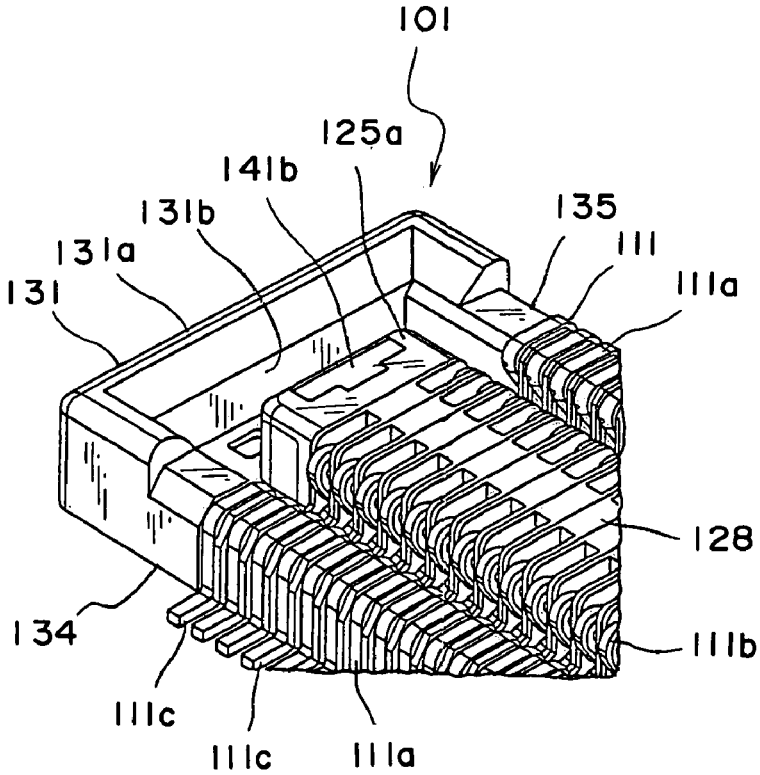
FIG. 12 is a perspective view of a part of the receptacle connector using the modification illustrated in FIG. 11.

Referring to FIGS. 11 and 12, description will be made of a modification of the receptacle connector 101.

The receptacle strengthening member 141 illustrated in FIG. 11 does not have the receptacle soldering portions mentioned above. The receptacle connector 101 having the receptacle strengthening member 141 is shown in FIG. 12. The other receptacle strengthening member 142 may have or may not have the receptacle soldering portions.

Figure 13:
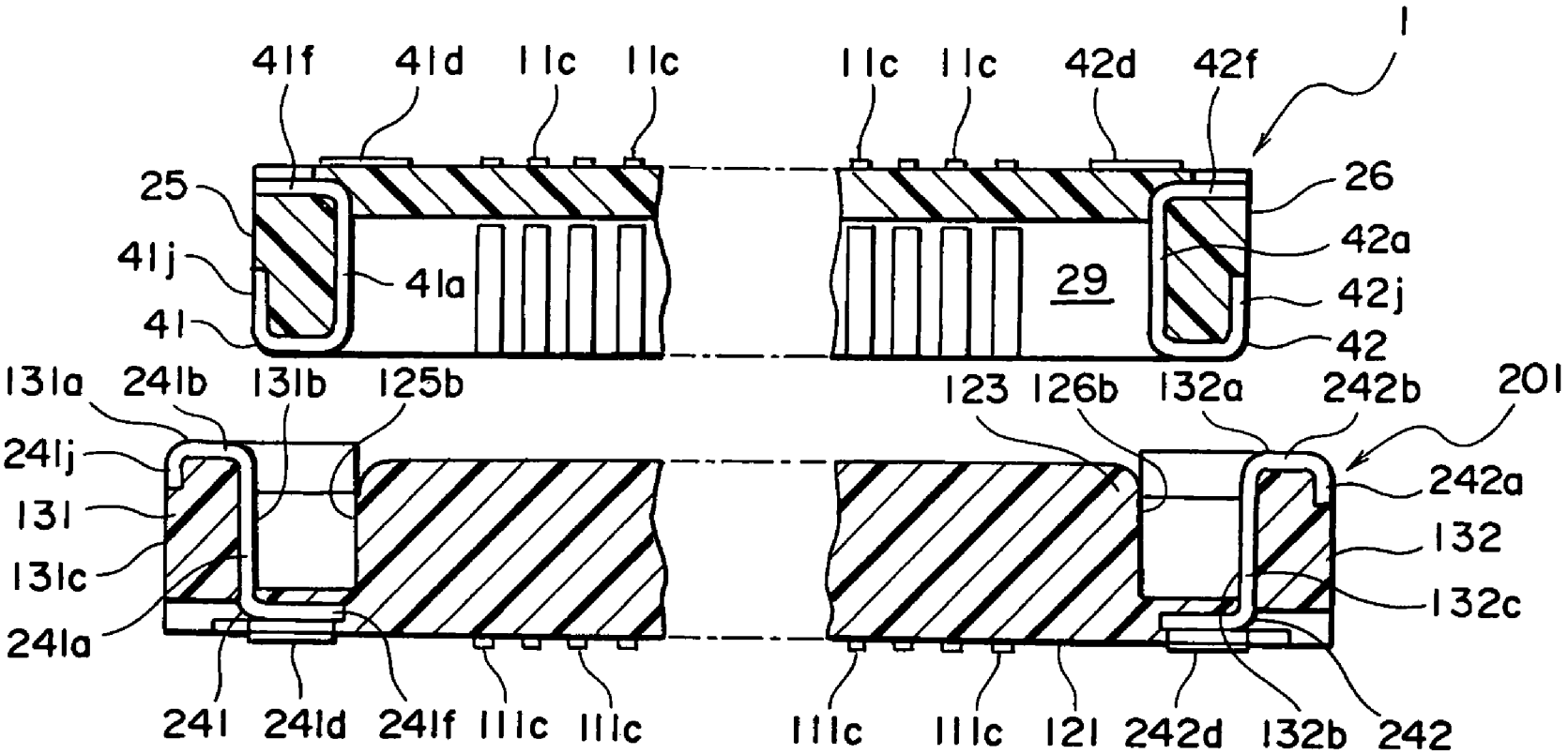
FIG. 13 is a sectional front view of an electrical connection apparatus according to a second embodiment of this invention before fitting.
Figure 14:
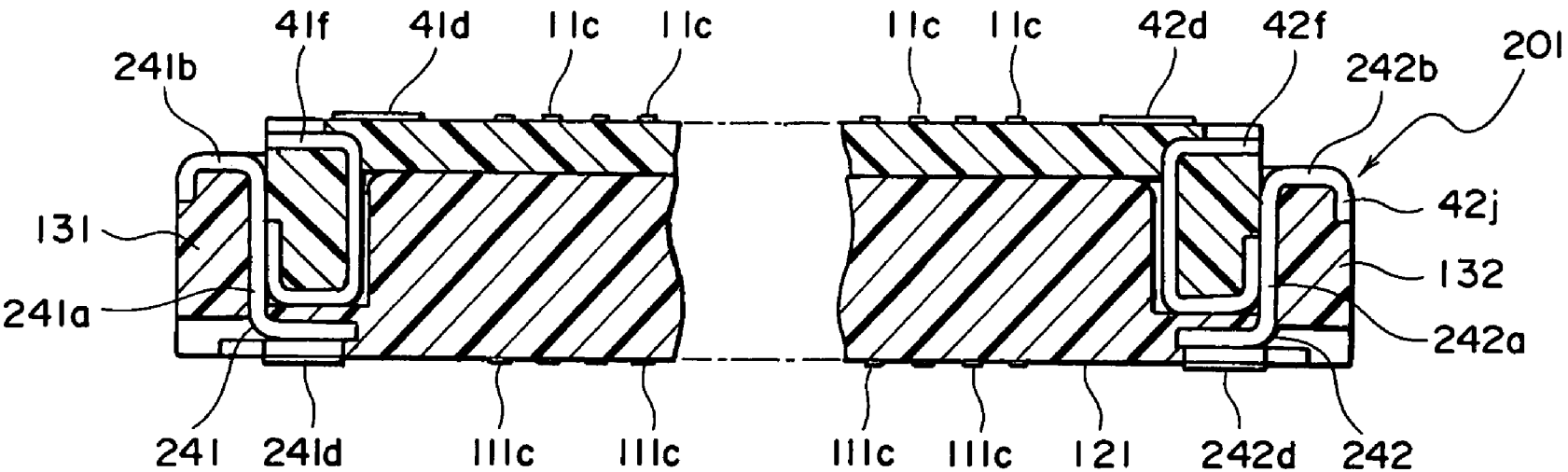
FIG. 14 is a sectional front view of the electrical connection apparatus in FIG. 13 after fitting.

Referring to FIGS. 13 and 14, description will be made of a whole of an electrical connection apparatus according to a second embodiment of this invention. Similar parts are designated by like reference numerals and description thereof will be omitted.

In the electrical connection apparatus illustrated in the figures, the plug connector 1 is similar to that of the electrical connection apparatus illustrated in FIGS. 1 and 2. On the other hand, in a receptacle connector 201, the first receptacle outer wall portions 131 and 132 are provided with receptacle strengthening members 241 and 242 made of metal, respectively. The receptacle strengthening members 241 and 242 extend along the receptacle fitting surfaces 131*a* and 132*a* and the first receptacle inner wall surfaces 131*b* and 132*b*.

The receptacle strengthening members 241 and 242 are held by the receptacle housing 121. Specifically, the receptacle strengthening members 241 and 242 are integrally held by the receptacle housing 121 by mold-in so that surfaces of the receptacle strengthening members 241 and 242 are substantially flush with surfaces of the receptacle fitting surfaces 131*a* and 132*a* and the first receptacle inner wall surfaces 131*b* and 132*b*.

Figure 15:
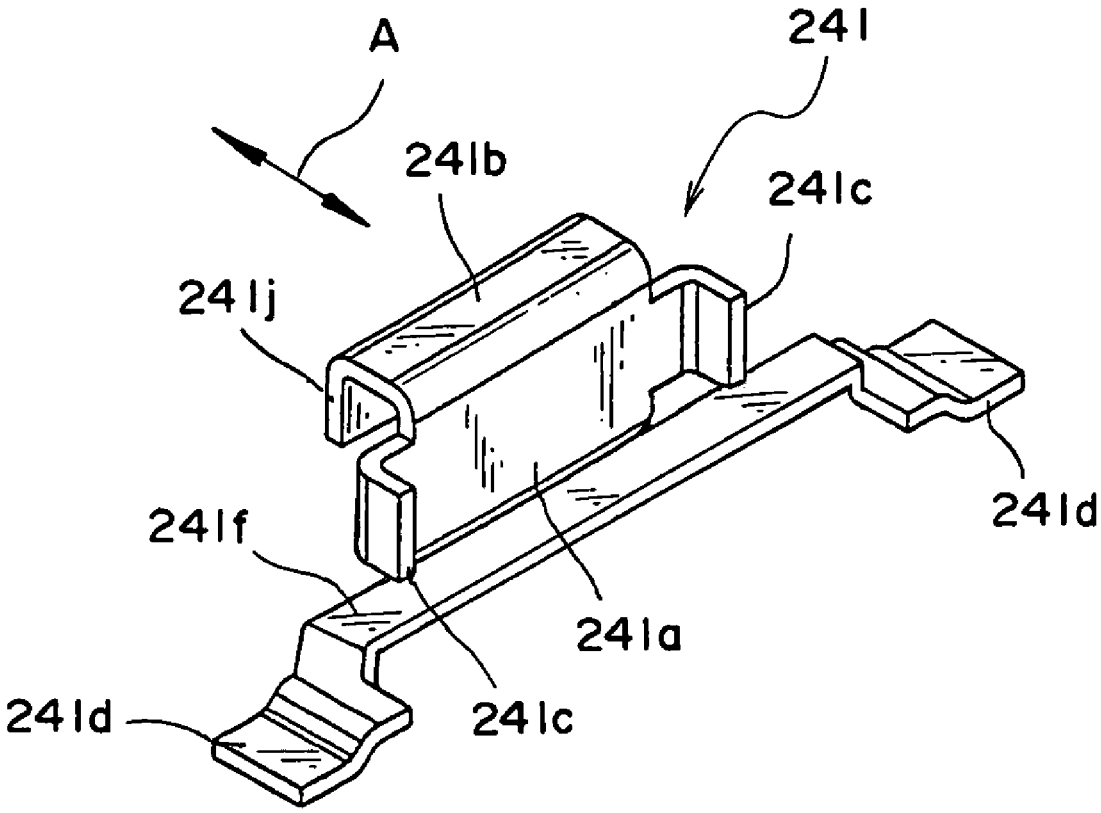
FIG. 15 is a perspective view of a receptacle strengthening member used in the electrical connection apparatus in FIGS. 13 and 14.

Referring to FIG. 15 in addition, the receptacle strengthening members 241 and 242 will be described. Since the receptacle strengthening members 241 and 242 have the same shape, the receptacle strengthening member 241 alone will be described herein. Each of the receptacle strengthening members 241 and 242 may be produced by punching and then bending a metal plate.

The receptacle strengthening member 241 has a first receptacle plate portion 241*a* of a flat shape, a second receptacle plate portion 241*b* connected to one side of the first receptacle plate portion 241*a* and bent in a generally inverted-U shape, a pair of third receptacle plate portions 241*c* connected to a pair of other sides of the first receptacle plate portion 241*a* and generally perpendicularly bent in a direction opposite to the second receptacle plate portion 241*b*, a receptacle connecting plate portion 241*f* connected to a lower side of the first receptacle plate portion 241*a* and generally perpendicularly bent in the direction opposite to the second receptacle plate portion 241*b*, and a pair of receptacle soldering portions 241*d* extending from the receptacle connecting plate portions 241*f* in the direction perpendicular to the pitch direction A.

An end portion 241*j* of the second receptacle plate portion 241*b* is disposed to be substantially flush with the first receptacle outer wall surface 131*c*. The third receptacle plate portions 241*c* are embedded in the second receptacle wall portion 134 (see FIG. 4) upon forming the receptacle housing 121 by mold-in. The receptacle soldering portions 241*d* extend in the direction same as the receptacle terminal portions 111*c* of the receptacle contacts 111 and are connected to a substrate (not shown) by the use of a solder.

The plug soldering portions 41*d* of the plug strengthening member 41 and the receptacle soldering portions 241*e* of the receptacle strengthening member 241 may not be provided if they are unnecessary.

Turning back to FIGS. 13 and 14, description will be made of a relationship between the plug connector 1 and the receptacle connector 201.

From the state shown in FIG. 13, the plug-side fitting portion 23 of the plug connector 1 is received in the receptacle-side fitting portion 123 of the receptacle connector 201 as shown in FIG. 14. When the plug connector 1 and the receptacle connector 201 are fitted to each other as described above, the first plug plate portions 41*a* and 42*a* of the plug strengthening members 41 and 42 and the first receptacle plate portions 141*a* and 142*a* of the receptacle strengthening members 141 and 142 are brought into frictional contact with each other. Therefore, even in a narrow-pitch condition in which distances or intervals of the plug contacts 11 and the receptacle contacts 111 in the pitch direction A are narrow, the possibility of causing improper contacting in the pitch direction A is low.

Upon fitting, the fitting is determined or accomplished by the plug strengthening members 41 and 42 and the receptacle strengthening members 241 and 242. Therefore, it is possible to prevent the plug housing 21 and the receptacle housing 121 from being abraded or broken during repetition of fitting and separation.

Further, the third receptacle plate portions 241*c* of the receptacle strengthening member 241 are embedded in the receptacle housing 121 in the manner similar to that described in connection with FIG. 8. Therefore, the receptacle housing 121 is further increased in rigidity. Even if twisting force is applied when the plug connector 1 is separated from the receptacle connector 201, the plug housing 21 is hardly deformed.

In the plug strengthening members 41 and 42 and the receptacle strengthening members 241 and 242, a spring member or a protrusion may be formed in one of the plug connector 1 and the receptacle connector 201. Upon fitting, the spring member or the protrusion is brought into contact with the plug strengthening members 41 and 42 or the receptacle strengthening members 241 and 242 in either direction.

The electrical connection apparatus in each of the foregoing embodiments is suitable for connection of a substrate such as a printed board, a FPC (Flexible Printed Circuit), or the like in various electronic apparatuses.

Although this invention has been described in conjunction with a few preferred embodiments thereof, this invention may be modified in various other manners within the scope of the appended claims.

What is claimed is:

1. A plug connector comprising:

a plurality of conductive contacts;

an insulating plug housing holding the contacts; and two plug strengthening members made of metal for strengthening the plug housing;

the plug housing having:

a pair of first plug wall portions extending and spaced from each other; and a pair of second plug wall portions defining a rectangular cavity between the first plug wall portions in cooperation with the first plug wall portions;

each of the first plug wall portions having:

a plug wall inner surface faced to the rectangular cavity;

a plug wall outer surface opposite to the plug wall inner surface; and a plug wall peripheral surface between the plug wall inner surface and the plug wall outer surface;

the contacts being disposed on at least one of the second plug wall portions;

the plug strengthening members being disposed on the first plug wall portions, respectively, and extending along at least one of the plug wall inner surface and the plug wall outer surface, wherein each of the plug strengthening members has a surface substantially flush with a surface of the plug housing.

2. The plug connector according to claim 1, wherein the plug strengthening members further extend along the plug wall peripheral surface.

3. The plug connector according to claim 1, wherein each of the first plug wall portions extends to connect the second plug wall portions to each other, the plug strengthening members being wound around the first plug wall portions, respectively.

4. The plug connector according to claim 1, wherein each of the plug strengthening members has a soldering portion protruding outward from the plug housing.

5. A plug connector comprising:

a plurality of conductive contacts;

an insulating plug housing holding the contacts; and two plug strengthening members made of metal for strengthening the plug housing;

the plug housing having:

a pair of first plug wall portions extending and spaced from each other; and a pair of second plug wall portions defining a rectangular cavity between the first plug wall portions in cooperation with the first plug wall portions;

each of the first plug wall portions having:

a plug wall inner surface faced to the rectangular cavity;

a plug wall outer surface opposite to the plug wall inner surface; and a plug wall peripheral surface between the plug wall inner surface and the plug wall outer surface;

the contacts being disposed on at least one of the second plug wall portions;

the plug strengthening members being disposed on the first plug wall portions, respectively, and extending alone at least one of the plug wall inner surface and the plug wall outer surface, wherein the plug strengthening members are integrally held by the plug housing by mold-in.

6. The plug connector according to claim 5, wherein the plug strengthening members further extend along the plug wall peripheral surface.

7. The plug connector according to claim 5, wherein each of the first plug wall portions extends to connect the second plug wall portions to each other, the plug strengthening members being wound around the first plug wall portions, respectively.

8. The plug connector according to claim 5, wherein each of the plug strengthening members has a soldering portion protruding outward from the plug housing.

9. A receptacle connector comprising:

a plurality of conductive contacts;

an insulating receptacle housing holding the contacts; and two receptacle strengthening members made of metal for strengthening the receptacle housing;

the receptacle housing having:

a pair of first receptacle groove portions extending and spaced from each other; and a pair of second receptacle groove portions defining a rectangular block portion between the first receptacle groove portions in cooperation with the first receptacle groove portions;

each of the first receptacle groove portions being defined by:

a receptacle groove inner surface defined by the rectangular block portion; and a receptacle groove outer surface faced to the receptacle groove inner surface;

the contacts being disposed to face at least one of the second receptacle groove portions;

the receptacle strengthening members extending along at least one of the receptacle groove inner surface and the receptacle groove outer surface to face the first receptacle groove portions, respectively.

10. The receptacle connector according to claim 9, wherein each of the receptacle strengthening members has a surface substantially flush with a surface of the receptacle housing.

11. The receptacle connector according to claim 9, wherein the receptacle strengthening members are integrally held by the receptacle housing by mold-in.

12. The receptacle connector according to claim 9, wherein each of the first receptacle groove portions extends to connect the second receptacle groove portions to each other.

13. The receptacle connector according to claim 9, wherein each of the receptacle strengthening members has a soldering portion protruding outward from the receptacle housing.

14. An electrical connection apparatus comprising a plug connector and a receptacle connector, the plug connector comprising:

a plurality of conductive contacts;

an insulating plug housing holding the contacts; and two plug strengthening members made of metal for strengthening the plug housing;

the plug housing having:

a pair of first plug wall portions extending and spaced from each other; and a pair of second plug wall portions defining a rectangular cavity between the first plug wall portions in cooperation with the first plug wall portions;

each of the first plug wall portions having:

a plug wall inner surface faced to the rectangular cavity;

a plug wall outer surface opposite to the plug wall inner surface; and a plug wall peripheral surface between the plug wall inner surface and the plug wall outer surface;

the contacts being disposed on at least one of the second plug wall portions;

the plug strengthening members being disposed on the first plug wall portions, respectively, and extending along at least one of the plug wall inner surface and the plug wall outer surface, the receptacle connector comprising:

a plurality of conductive contacts;

an insulating receptacle housing holding the contacts; and two receptacle strengthening members made of metal for strengthening the receptacle housing;

the receptacle housing having:

a pair of first receptacle groove portions extending and spaced from each other; and a pair of second receptacle groove portions defining a rectangular block portion between the first receptacle groove portions in cooperation with the first receptacle groove portions;

each of the first receptacle groove portions being defined by:

a receptacle groove inner surface defined by the rectangular block portion; and a receptacle groove outer surface faced to the receptacle groove inner surface;

the contacts being disposed to face at least one of the second receptacle groove portions;

the receptacle strengthening members extending along at least one of the receptacle groove inner surface and the receptacle groove outer surface to face the first receptacle groove portions, respectively.

* * * * *